United States Patent [19]

Daigle

[11] 4,072,840

[45] Feb. 7, 1978

[54] REMOVABLE KEYBOARD SWITCH

[75] Inventor: Phillip R. Daigle, Glenridge, N.J.

[73] Assignee: Litton Business Systems, Inc., Morristown, N.J.

[21] Appl. No.: 615,038

[22] Filed: Sept. 19, 1975

Related U.S. Application Data

[62] Division of Ser. No. 519,617, Oct. 31, 1974, abandoned.

[51] Int. Cl.[2] ..... H01H 9/08

[52] U.S. Cl. ..... 200/296; 361/350; 248/27.1

[58] Field of Search ..... 248/27 R, 27 A; 339/128; 317/112; 200/296, 293, 295, 307; 338/228, 315, 317; 361/331, 350

[56] References Cited

U.S. PATENT DOCUMENTS

| | | | |
|---|---|---|---|
| 2,874,254 | 2/1959 | Daily | 248/27 A |
| 2,938,188 | 5/1960 | Lazzery | 339/128 |
| 3,084,962 | 4/1963 | Feuerbacher | 248/27 A |
| 3,469,051 | 9/1969 | Yamada | 200/296 |

*Primary Examiner*—Gerald P. Tolin
*Attorney, Agent, or Firm*—Robert F. Rotella; Norman Friedman

[57] ABSTRACT

A manually actuable keyboard switch is provided having two opposite relieved openings in its base portion so that when it is inserted into an aperture in a keyboard switch retainer having two tabs outwardly extending and depending from opposite sidewalls of the aperture, the tabs spring into their original positions and within said relieved openings to hold said keyboard switch therein.

5 Claims, 6 Drawing Figures

REMOVABLE KEYBOARD SWITCH

This is a division of application Ser. No. 519,617 filed Oct. 31, 1974, and now abandoned.

BACKGROUND OF THE INVENTION

Removable electrical switches used in keyboards have been developed but these have various shortcomings which affect their usefulness. These devices have employed an inclined tab on opposite sides of the walls of the base of the switch housing which snap into the notched apertures of a keyboard switch retainer. Such switches are not easily removed from the keyboard unless the full keyboard assembly is removed from its associated instruments.

SUMMARY OF THE INVENTION

It is, therefore, an object of this invention to provide an improved manually actuable electric keyboard switch and retainer capable of being utilized in keyboards used in the computer and data processing field.

A further object of this invention is to provide a reliable manually actuable keyboard switch and retainer capable of being utilized in keyboards.

An additional object of this invention is to provide a keyboard switch which is easily removed from a keyboard switch retainer.

A still further object of this invention is to provide an improved keyboard switch and retainer which keyboard switch can be easily removed and reoriented or replaced to provide a different function.

These and other objects of the present invention are accomplished in the illustrative embodiment by providing a manually actuable keyboard switch having two opposite relieved openings in its base portion so that when it is inserted into an aperture in a keyboard switch retainer having two tabs outwardly extending and depending from opposite sidewalls of the aperture, the tabs spring into their original positions and within said relieved openings to hold said keyboard switch therein. By use of a special tool said keyboard switch is easily removed by inserting the tool through the top of the switch into notches formed in the base portion of the keyboard switch above and below the relieved openings to deflect the tabs out of the openings thereby permitting the tool to remove the keyboard switch.

DETAILED DESCRIPTION OF THE INVENTION

Figure 1:
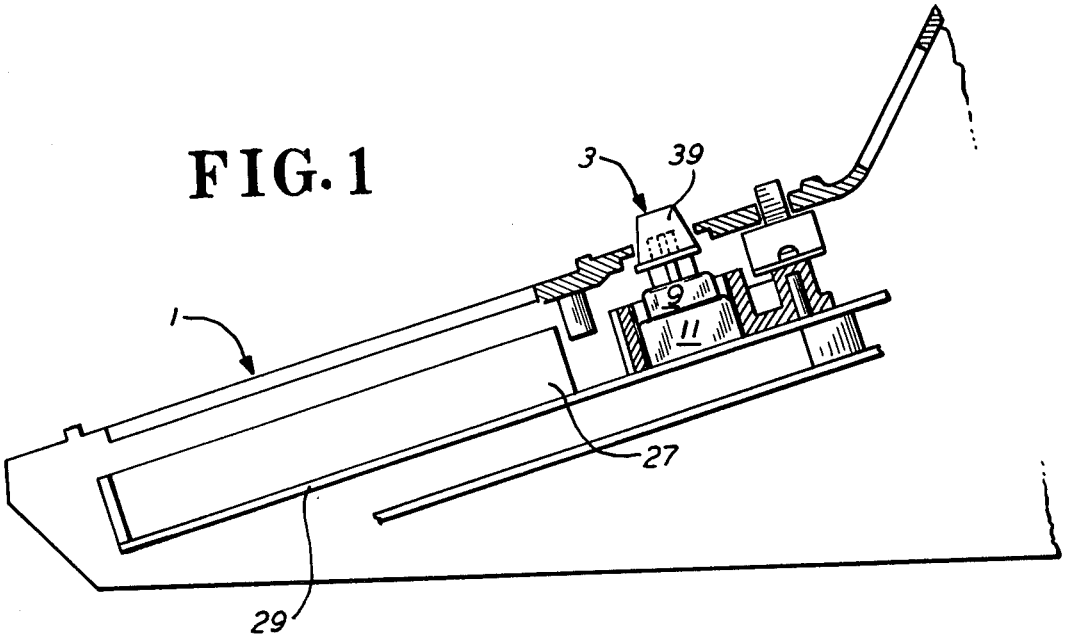
FIG. 1 is a simplified cross-sectional view of a pushbutton station of a portion of a calculator's casing assembly embodying the present invention.
Figure 2:
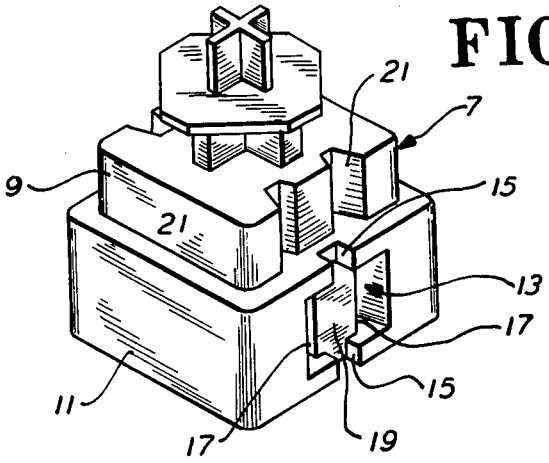
FIG. 2 is a perspective view of the exterior of a keyboard switch embodying the instant invention.
Figure 3:
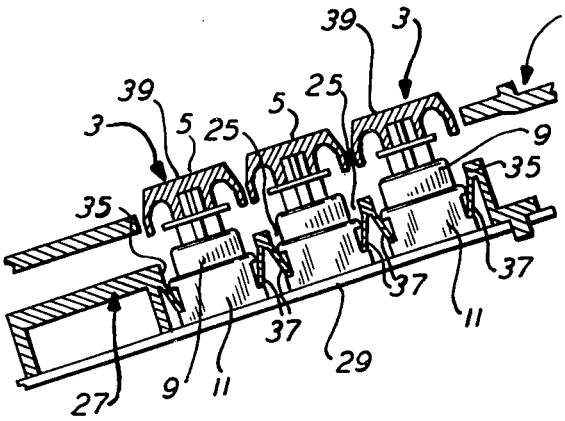
FIG. 3 is a simplified cross-sectional view of a plurality of keyboard switches in a keyboard switch retainer embodying the present invention.
Figure 4:
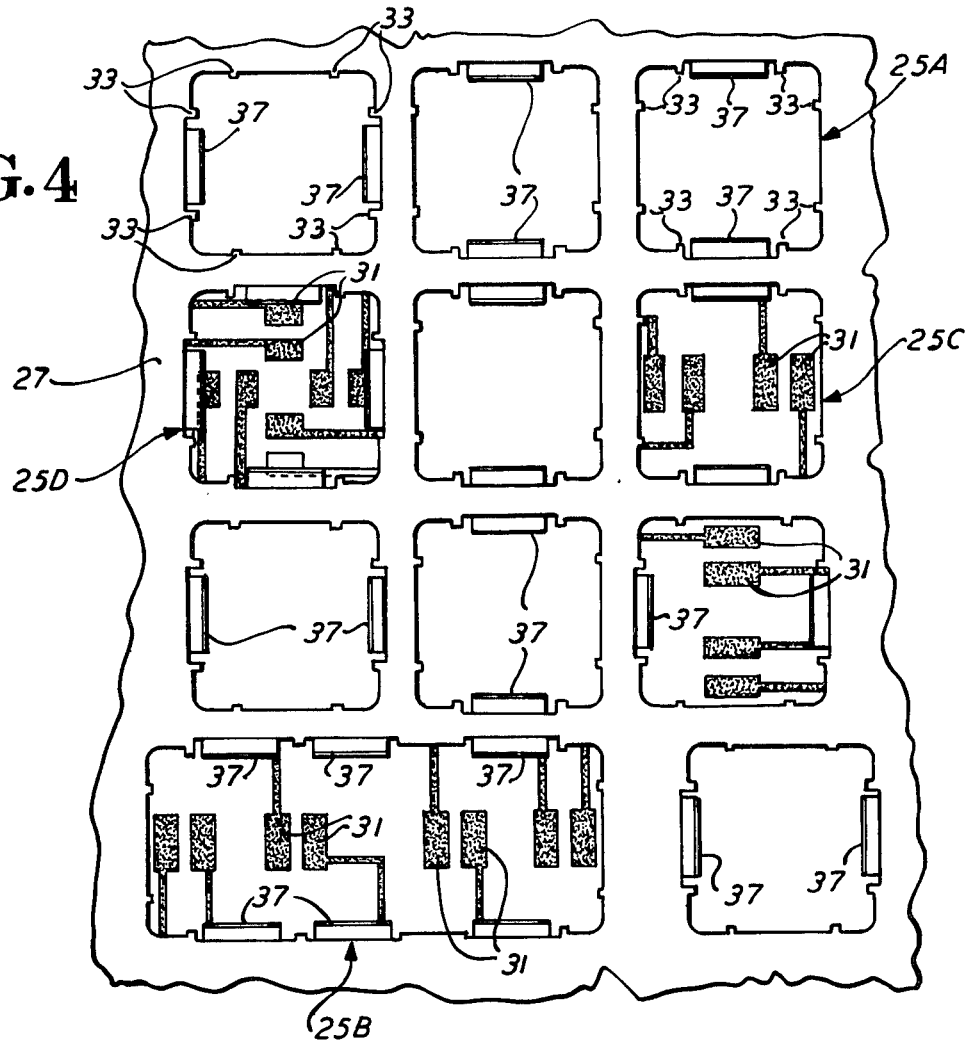
FIG. 4 is a simplified partial top view of a keyboard switch retainer and printed circuit board embodying the invention.
Figure 5:
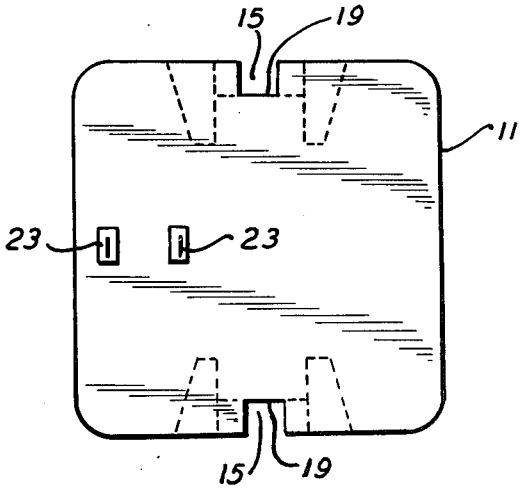
FIG. 5 is a detailed view of the bottom of the keyboard switch of FIG. 2.

Referring to the drawings and particularly to FIG. 1, a pushbutton station of a calculator is shown employing a casing assembly 1 embodying the present invention. Referring now also to FIGS. 2, 3, and 5 the keyboard includes a plurality of generally square pushbutton keyboard switches. The keyboard switch 3's housing is preferably formed in two pieces from a moldable, conventional thermoplastic resin. The keyboard switch 3 comprises an actuator 5 which projects into the housing 7 to actuate a conventional internal switch (not shown). The housing 7 comprises a top portion 9 and a base portion 11. The base portion 11 has two opposite side walls which are flat and two other side walls which have relieved openings 13. Above and below said openings 13, and in the center thereof, two notches 15 are formed. The openings 13, themselves have two slots 17 therein, and an inner flat back wall 19 connecting adjacent inner edges of said slots 17. Said back wall's 19 surface extends into the end of the notches 15. The top portion 9, of generally square configuration, connected to the top surface of the base portion 11, reduced in width by approximately the dimensions of the notches 15, having two opposing outside flat walls and two other outside walls which have two substantially "V" shaped notches 21 therein. Each keyboard switch 3 has a plurality of protruding terminals 23 disposed on the underside or base portion of the keyboard switch 3. Each group of keyboard switches 3 extends through and project above an aperture in the casing assembly 1. Referring now also to FIG. 4, each keyboard switch 3 extends through individual apertures 25 in a keyboard switch retainer 27 located below said casing assembly 1. The inner walls defining the keyboard switch apertures 25 function to guide the keyboard switches 3 into a fixed position in the keyboard switch retainer 27. Attached to the bottom side of the keyboard switch retainer 27 is a printed circuit board 29. The terminals 23 which protrude from the base of the keyboard switch 3 are positioned in contact with associated pads 31 which are directly disposed below them and which are provided on the face of the printed circuit board 29. When a pushbutton keyboard switch 3 is depressed, it actuates its interior switch completing the circuit.

Figure 6:
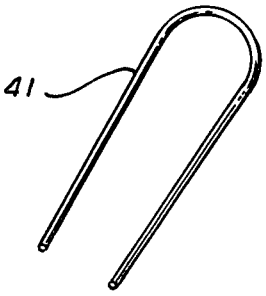
FIG. 6 is a perspective view of a tool for removing the keyboard switch of FIG. 2.

Referring particularly to FIG. 4, the keyboard switch retainer 27 comprises a plurality of switch apertures 25A and 25B. Group switch apertures 25B are constructed so that a single or a plurality of individual, and independently operable, keyboard switches 3 extend therethrough, and in this embodiment two keyboard switches can be disposed therein. The individual switch apertures 25A are configured to have generally square openings, with small rounded corners. Two of the opposing walls are generally flat and extend to the bottom of the keyboard retainer 27. Each of the four walls however, have a raised portion 33, spaced from the corners, extending the length of the aperture and perpendicular to the top surface of the keyboard retainer 27. Such raised portions 33 provide easy insertion and removal of said keyboard switch 3 by a special tool, shown in FIG. 6. The other two inner opposing walls both have an upper portion 35 which is flat. The portions below said upper portions 35 have a generally rectangular shaped flexible tabs 37, angularly depending from the bottom of said upper portions 35 and extending toward the bottom opening of said aperture and extending outwardly from each of two opposite sides thereof toward each other. Depending on the particular apertures' relationship to another nearby aperture, either a flat spaced wall (not shown) will bound the inside portion of tab 37 or another tab 37 of another adjacent aperture will depend from its upper portion 35 into the adjacent aperture. These individual apertures 25A will utilize a keyboard switch 3 having a manually engageable element such as an indicia displaying pushbutton or key top 39 on the actuator 5 of square configuration which fits snugly above and completely over said individual aperture 25A.

Group switch apertures 25B are designed similar to the individual apertures 25A except that they are configured to have a generally elongated rectangular opening, wide enough for a keyboard switch 3 and generally wide enough for a plurality of adjacent keyboard switches 3, two in this embodiment thereby providing a choice of three positions, to fit snugly into. The long sides of the aperture have a plurality of tabs 37, three in this emodiment, positioned in substantially the same manner as in the individual apertures 25A. The short sides are designed in the same manner as the individual apertures 25A. Such group apertures usually have mounted on a single keyboard switch 3 a manually engageable element such as an indicia displaying pushbutton or key top 39, configured to fit snugly above and completely over said group apertures 25B.

When a keyboard switch 3 is inserted into an aperture, such as an individual aperture 25A, the walls of the base portion 11 which have relieved openings 13 force the depending flexible tabs 37 to deflect until the relieved openings 13 clears the bottom end of the tabs 37 which in such position are no longer under a load thereby allowing said tabs 37 to spring back to their original position which is now inside the relieved openings 13 of the keyboard switch 3. The only way the keyboard switch 3 can be removed, once it is inserted into one of the apertures, is to use the "U" shaped tool 41 shown in FIG. 6. This is accomplished by inserting the ends of the prongs of the tool 41 through the upper and lower notches 15 of the keyboard switch, and pulling the keyboard switch 3 away from the keyboard switch retainer 27. The insertion of the prongs of the tool 41 deflects the tabs 37 out of the relieved openings 13 allowing the keyboard switch 3 to be pulled out of its aperture.

Referring again to FIG. 4 the provision of electrical pads 31 in sets of two, 180° apart, aperture 25C, the preferred embodiment, or in sets of four, 90° apart, aperture 25D, another embodiment which would necessitate a keyboard switch 3 with two sets of relieved openings and two sets of depending tabs, when the keyboard switch 3 is removed and rotated 90°, 180° or270° to make contact with a new set of pads on the printed circuit board 29 gives the keyboard switch 3 a completely different function if desired. Also such design could also be used to provide an insured second position, using two sets of pads, aperture 25C, 180° apart, whose function would be the same in case the first position should fail for mechanical or electrical reasons, making the device extremely reliable.

Obviously, many modifications and variations of the present invention are possible in light of the above teachings. It is therefore, to be understood that within the scope of the appended claims the invention may be practiced otherwise than as specifically described.

What is claimed is:

1. A keyboard assembly comprising:

a keyboard switch retainer including a first substantially flat plate having at least one aperture adapted for inserting a keyboard switch therein, said aperture having a generally rectangular configuration and having two opposite walls which are substantially flat and at least two opposite portions of said other walls having angularly depending flexible tabs;

a keyboard switch adapted for being seated into said aperture, said switch having a housing assembly having four walls, two of said opposite walls being substantially flat and the other two walls having relieved openings therein;

said tabs being deformed to a first position by the edges of said walls having relieved openings therein during seating of said keyboard switch thereby permitting said keyboard switch to be seated into said aperture;

said tabs being received by said relieved openings and assuming a second position once said keyboard switch has been seated thereby retaining said keyboard switch in a seated position;

said keyboard switch being removable through said aperture by moving said tabs away from said relieved openings thereby freeing said keyboard switch from its seated position;

said tabs being movable away from said relieved openings by the insertion of a member through said aperture to deform said tabs to said first position.

2. A keyboard assembly as set forth in claim 1, wherein:

said tabs assume said second position whenever a keyboard switch is not in a seated position.

3. A keyboard assembly as set forth in claim 1, further including:

a second substantially flat plate spaced from and parallel to said first plate;

said keyboard switch resting against said flat plate when said switch is seated.

4. A keyboard assembly as set forth in claim 1, wherein:

said relieved openings each comprise a back wall portion spaced from a parallel to the surface of its respective wall.

5. A keyboard assembly as set forth in claim 4, wherein:

each of said relieved opening back wall portions include a pair of slots.

* * * * *